US005669321A

United States Patent [19]

Migliorini

[11] Patent Number: 5,669,321

[45] Date of Patent: Sep. 23, 1997

[54] STOCKING-HOLDER SHAPE FOR PANTYHOSE SEWING MACHINE

[75] Inventor: Pier Lorenzo Migliorini, Terranuova Bracciolini, Italy

[73] Assignee: Solis S.R.L., Tavarnuzze, Italy

[21] Appl. No.: 643,856

[22] Filed: May 7, 1996

[30] Foreign Application Priority Data

May 10, 1995 [IT] Italy ..... FI95A0098

[51] Int. Cl.[6] ..... D06C 5/00

[52] U.S. Cl. ..... 112/470.08; 112/470.15; 112/470.12; 223/77; 223/75

[58] Field of Search ..... 223/75, 77, 72, 223/74; 112/470.08, 470.15, 470.12; 267/158, 41, 44

[56] References Cited

U.S. PATENT DOCUMENTS

| | | | |
|---|---|---|---|
| 1,284,738 | 11/1918 | McCarthy | 223/77 |
| 2,639,139 | 5/1953 | Carlson | 267/158 |
| 2,643,030 | 4/1953 | Hershberger | 223/74 |
| 2,948,447 | 8/1960 | Journey et al. | 223/74 |
| 3,726,451 | 4/1973 | Blevens | 223/74 |
| 3,811,607 | 5/1974 | Glaze, Jr. | 223/77 |
| 4,188,897 | 2/1980 | Takatori | 112/470.15 |
| 4,224,885 | 9/1980 | Takatori | 112/470.15 |
| 4,598,656 | 7/1986 | Calamani et al. | 112/470.08 |

*Primary Examiner*—Bibhu Mohanty
*Attorney, Agent, or Firm*—McGlew and Tuttle

[57] ABSTRACT

Improved stocking-holder shape comprising two contouring flat elements that can be stretched apart under control, wherein each of said flat elements is provided, in correspondence of the respective outer side, with a flexible and elastic body which has one end fixed, at the level of the front portion of the flat element, while the other end is free, so as to allow for the elastic yielding thereof and the movement of said free end close to the side of the flat part, during the stretching apart of the flat elements, owing to the action exerted by the fabric of the stocking. (FIG. 1).

13 Claims, 2 Drawing Sheets

STOCKING-HOLDER SHAPE FOR PANTYHOSE SEWING MACHINE

FIELD OF THE INVENTION

The present invention relates to an improved stocking-holder shape for pantyhose sewing machine.

BACKGROUND OF THE INVENTION

It is known that in order to manufacture a pantyhose article, it is first necessary to individually fit or "load" two stockings on paired and superimposed flat shapes and then vertically align them and move them close to each other so as to have a correspondence between the elastic hems of the two stockings and the respective garter lines, the latter defining the line of demarcation between two regions of different consistency, such as the bodice and leg of each stocking. Afterwards, the two stockings thus positioned must be longitudinally cut, starting from the elastic hem of the bodice, over a length of predetermined extent. Thereafter, the giuxtaposed hems of the two thus cut stockings must be sewn together to form a pantyhose article, with said shapes being in stretched apart condition.

It thus follows that to carry out the cutting and subsequent sewing of the two stockings with the required accuracy, it is necessary that the two stockings be correctly fitted and positioned on the support shapes beforehand.

It is also known that the stocking-holder shapes currently used comprise two flat elements each of which is provided, in correspondence of the respective outer side, with a coplanar, longitudinal and substantially cylindrical element of reduced cross-section and mixtilinear profile, having a projection directed outwardly and located midway of its length, which is commonly called "iron": the two ends of said iron being made removably solid to the corresponding flat element of the shape. Currently, said side irons provide exclusively for putting in tension the shape-supported stocking at the region intended to form the pantyhose bodice. Said irons have dimensions preset according to the size of the bodice of the pantyhose to be formed. FIG. 4 of the attached drawings illustrates a stocking-holder shape provided with said traditional irons (F).

However, said known shapes exhibit some drawbacks due mainly to the rigidity of the irons, which causes the fabric of the stockings to exert an excessive resistance to the stretching apart or opening of the shapes, and to the fact that the same irons must be replaced whenever the size of the stocking in the course of formation and/or the length of stocking portion intended to form the pantyhose bodice is changed.

SUMMARY AND OBJECTS OF THE INVENTION

The main object of the present invention is to overcome the above said drawbacks.

This result has been achieved, according to the invention, by adopting the idea of making an improved shape for pantyhose sewing machine having the features of first and second contouring elements, with each contouring element having a first and second end. The first and second contouring elements being positionable together to receive a stocking, and positionable apart to stretch apart the stocking. First and second flexible bodies are mounted on respective first and second contouring element, with each flexible body having a first end fixed to the first end of the respective contouring element and having a second end movable toward and away from the second end of the respective contouring element. The flexible bodies each have flex means for yielding towards the respective contouring element under an action of the stocking during movement apart of the first and second contouring elements. Further characteristics being set forth in the dependent claims.

The advantages deriving form the present invention lie essentially in that the loading capacity of the shapes results increased, as it is possible to fit on a same shape, without replacing any element thereof, stockings of any size and/or length; that is always possible to achieve and maintain the correct positioning of the stockings over the shapes; that a quick response of the fabric to the stretching apart of the shapes is obtained with no resistance therefrom; that an improved shape according to the invention is simple to make, cost-effective and reliable even after a prolonged service life.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DETAILED DESCRIPTION OF THE PREFERRED EMBODIMENT

Figure 4:
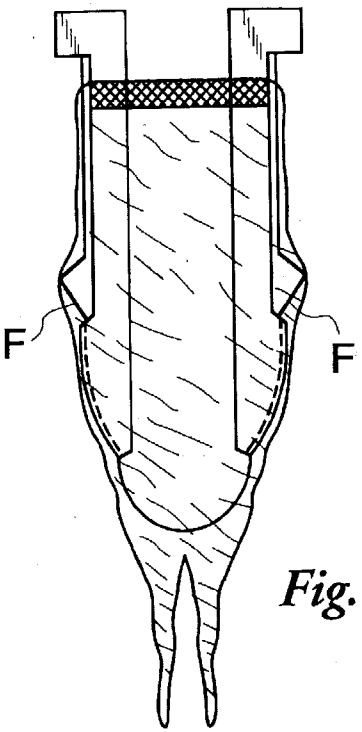
FIG. 4 shows the plan view of a stocking-holder shape provided with side rigid irons (F) of known type.

Reduced to its basic structure, and reference being made to the figures of the attached drawings, an improved stocking-holder shape, according to the invention, comprises two contouring flat elements (1) held together by a holding means and known per se. Each flat element is provided, in correspondence of its outer side, and in place of the traditional rigid irons (F), with a flexible and elastic body (2) with only one end fixed (20) in correspondence of the front portion (10) of the flat element (1), and the other end (21) free, so as to allow for the elastic yielding thereof and the movement of the free end (21) close to the side of the flat part (1) during the stretching apart of the flat elements as a consequence of the action exerted by the fabric of the stocking (4) after the cutting thereof.

Advantageously, according to the invention, said elastic body (2) consists of an arcuate lamina, with its concavity facing the respective shape (1) and its fixed end (20) inserted into a corresponding lateral slot of the front part (10) of the shape (1). This providing an easier assembly thereof.

Moreover, advantageously, according to the invention, a fixed body (3) is provided at a predetermined position of the shape (1), which makes up the abutting element for stopping the outward travel of the free end (21) of the element (2) into resting condition.

Figure 1:
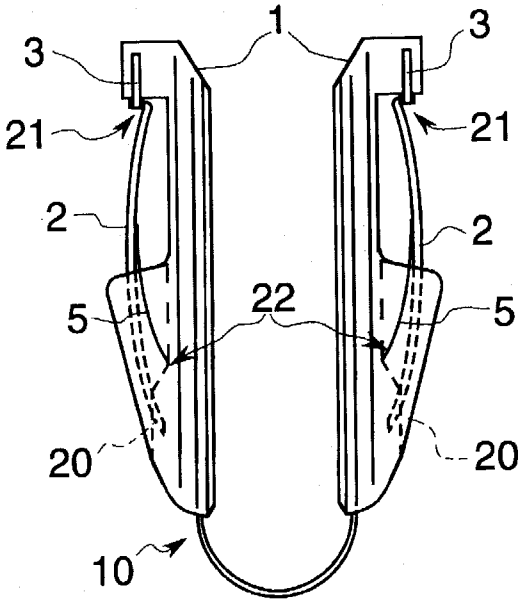
FIG. 1 shows a plan view of an improved shape, according to the invention, in inoperative condition and without stocking thereon.

It is also advantageously provided that, as illustrated in FIG. 1, each body (2) be associated to a flexible and elastic lamina (5) of leaf spring shape to increase the rigidity of the body (2) at the respective central region: one end of said lamina (22) being engaged to the stocking-holder shape and the other end being free and close to the body (2).

With reference to the case of the use of two shapes, according to the invention, for the formation of a pantyhose article, the operation is as follows.

Figure 2:
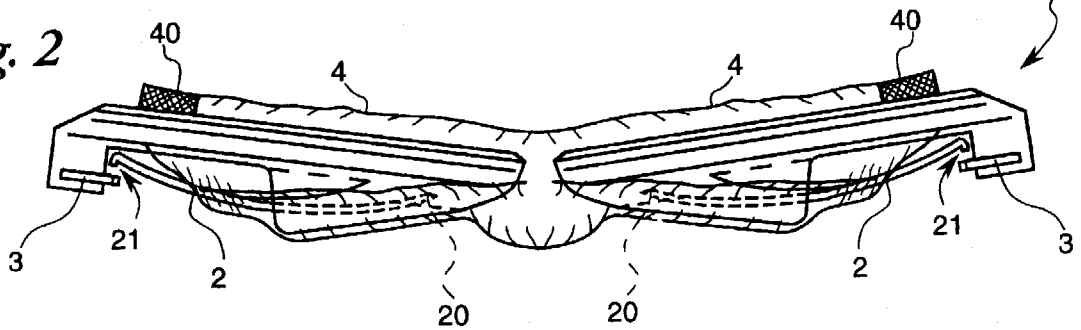
FIG. 2 shows the plan view of the shape of FIG. 1, in stretched apart condition and with a stocking fitted thereon.
Figure 3:
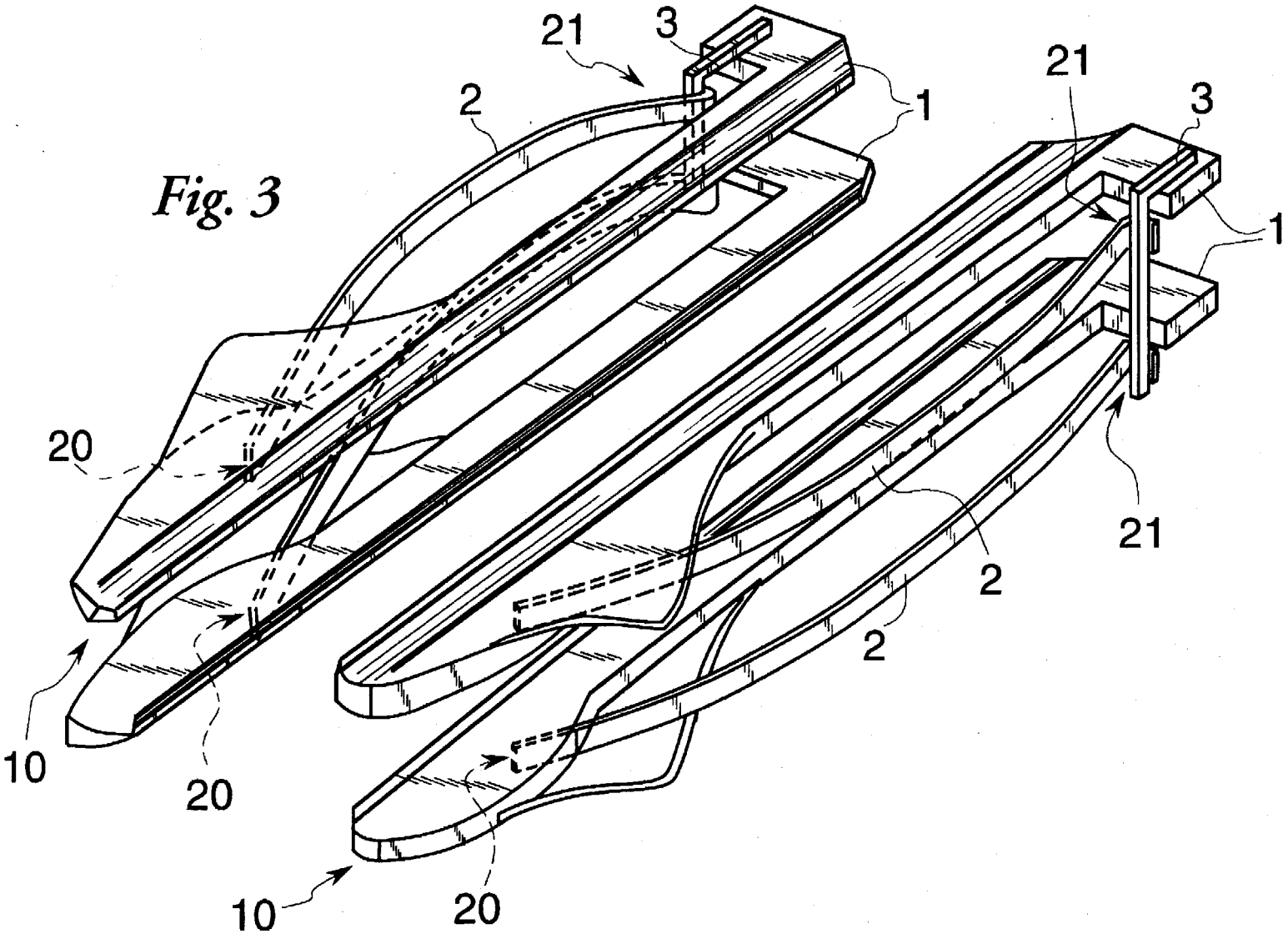
FIG. 3 shows a simplified perspective view of a pair of shapes of the type of FIG. 1.

Upon loading the stockings (4) onto the shapes (1), each element (2) becomes elastically deformed by the action exerted thereon by the elastic hem (40) of the respective stocking, until it takes up a balance configuration as determined by the elastic characteristics or flex means of the same element (2) and of the article, with the free end (21) detached from the shape. In this way, the elastic hems and the parts of the stockings intended to form the bodice of the pantyhose will result correctly tensioned whatever the size, consistency and length of the bodice to be obtained and of the elastic hem of the stockings. After the shapes (1) have been moved close to each other and the longitudinal cutting of the bodices performed by a known per se technique, each of said elements (2) results with the respective free end (21) being subject to the action of the elastic hem (40) of the corresponding stocking (4), thus making it possible to check for the approach thereof to the respective shape (1). Therefore, upon the subsequent step for the stretching of the shapes (see FIG. 2), also operated according to procedures known per se to those skilled in the art, said shapes will result free from the resistent action of the elastic hems of the stockings, contray to the case of the shapes being provided with side irons.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

We claim:

1. A improved stocking-holder for supporting stockings comprising two contouring flat elements connected by a flexure element that can be stretched apart under control for supporting stockings wherein the improvement comprises: each of said flat elements being provided, in correspondence of the respective outer side, with a flexible and elastic body which has one end fixed at a front portion of the flat element, while another end is free, so as to allow for elastic yielding thereof and movement of said free end close to a side of the flat part, during the stretching apart of the flat elements, owing to action exerted by fabric of the stocking.

2. Shape according to claim 1 wherein said elastic body is made up of an arcuate lamina, with a concavity facing the respective shape of the stocking holder, and in that its fixed end is inserted into a corresponding side slot of the front part of the shape.

3. Shape according to claim 1 wherein a body is fixed at a predetermined position on said flat elements which makes up an abutting element for stopping the outward travel of the free end of the flexible body and forming a resting condition, said abutting element holding said flexible body movable inward toward said side of said contour flat element.

4. Shape according to claim 1, wherein associated with each elastic body is a flexible and elastic lamina of leaf spring shape to increase a rigidity of the elastic body at a respective central region; one end of said lamina being engaged to the stocking-holder shape and the other end being free and close to the elastic body.

5. A stocking holder for supporting stockings comprising:

first and second contouring elements connected by a flexure member, each contouring element having a first and second end, said first and second contouring elements being positionable together to receive a stocking, and positionable apart to stretch apart the stocking;

first and second flexible bodies mounted on a respective said first and second contouring element, each said flexible body having a first end fixed to said first end of said respective contouring element and having a second end movable toward and away from said second end of said respective contouring element, said flexible bodies each having flex means for yielding towards said respective contouring element under an action of the stocking during movement apart of said first and second contouring elements.

6. A shape in accordance with claim 5, wherein:

said first and second contouring elements are substantially parallel and side by side when positioned together, said first and second contouring elements are substantially aligned end to end when positioned apart.

7. A shape in accordance with claim 5, wherein:

said second end of said flexible bodies are movable perpendicular to a longitudinal axis of said respective contour element.

8. A shape in accordance with claim 5, wherein:

said first and second contouring elements are more rigid than said flexible bodies.

9. A shape in accordance with claim 6, further comprising:

holding means for holding said first ends of said contouring elements together while said first and second contouring elements are movable together and apart, said holding means holding said first and second contouring elements receivable of a stocking when said first and second contouring elements are positioned together.

10. A shape in accordance with claim 5, wherein:

each of said respective flexible bodies extends from said first end of said respective contour element to said second end of said respective contour element.

11. Shape according to claim 5 wherein:

said flexible body is made up of an arcuate lamina, with a concavity facing the respective contour element, said first end of said flexible body being inserted into a corresponding side slot of said first end of said respective contour element.

12. Shape according to claim 5, wherein:

a body is fixed at a predetermined position on said contouring elements which makes up an abutting element for stopping outward travel of the first end of the flexible body, said abutting element holding said flexible body movable inward toward said side of said contour element.

13. Shape according to claim 5, wherein:

associated with each flexible body is a flexible and elastic lamina of leaf spring shape to increase a rigidity of the elastic body at a respective central region; one end of said lamina being engaged to the stocking-holder and the other end being free and close to the flexible body.

* * * * *